US009805657B2

(12) United States Patent
Kwon et al.

(10) Patent No.: US 9,805,657 B2
(45) Date of Patent: Oct. 31, 2017

(54) SCAN DRIVER AND ORGANIC LIGHT EMITTING DISPLAY DEVICE USING THE SAME

(71) Applicant: LG Display Co., Ltd., Seoul (KR)

(72) Inventors: Junyoung Kwon, Busan (KR); Jaeho Sim, Daegu (KR); Jungchul Kim, Gyeonggi-do (KR); Euncheol Eom, Jeollabuk-do (KR)

(73) Assignee: LG Display Co., Ltd., Seoul (KR)

( * ) Notice: Subject to any disclaimer, the term of this patent is extended or adjusted under 35 U.S.C. 154(b) by 45 days.

(21) Appl. No.: 14/745,697

(22) Filed: Jun. 22, 2015

(65) Prior Publication Data

US 2016/0005359 A1 Jan. 7, 2016

(30) Foreign Application Priority Data

Jul. 3, 2014 (KR) ..... 10-2014-0083311

(51) Int. Cl.
*G09G 5/00* (2006.01)
*G09G 3/3266* (2016.01)

(52) U.S. Cl.
CPC ... *G09G 3/3266* (2013.01); *G09G 2300/0814* (2013.01); *G09G 2300/0819* (2013.01); *G09G 2310/0286* (2013.01); *G09G 2320/0247* (2013.01); *G09G 2320/045* (2013.01); *G09G 2330/026* (2013.01)

(58) Field of Classification Search
CPC ..... G09G 3/3266; G09G 2300/0814; G09G 2300/0819; G09G 2310/0286; G09G 2320/045; G09G 2320/0247; G09G 2330/026
USPC ..... 345/76, 82, 100, 211–214, 691–694; 326/25, 102, 113; 257/205, 392
See application file for complete search history.

(56) References Cited

U.S. PATENT DOCUMENTS 5,563,624 A * 10/1996 Imamura ..... G06F 3/147 345/100
6,421,038 B1 * 7/2002 Lee ..... G09G 3/3677 345/87

(Continued)

FOREIGN PATENT DOCUMENTS

CN 1622181 A 6/2005
CN 1855200 A 11/2006

(Continued)

OTHER PUBLICATIONS

First Notification of Office Action dated Jul. 3, 2017 from The State Intellectual Property Office of China in related Chinese application No. 201510386593.4 (US 2008/246698A1 already of record).

*Primary Examiner* — Prabodh M Dharia
(74) *Attorney, Agent, or Firm* — Morgan, Lewis & Bockius LLP

(57) ABSTRACT

A circuit has a first portion configured to act as a shift register to provide an output signal via an output terminal, and a second portion configured to act as an inverter to invert the output signal at the output terminal of said first portion from a logic high state to a logic low state or vice versa. This is to forcibly turn off one or more transistors in a pixel circuit that provides subpixel or pixel-related control in an OLED display, such that an anode voltage of an organic light emitting diode does not exceed a turn-on voltage thereof.

22 Claims, 9 Drawing Sheets

(56) References Cited

U.S. PATENT DOCUMENTS

2004/0179005 A1* 9/2004 Jo ..... G09G 3/325 345/211
2005/0104815 A1* 5/2005 Komiya ..... G09G 3/3233 345/76
2006/0001640 A1* 1/2006 Lee ..... G09G 3/3677 345/100
2007/0018917 A1* 1/2007 Miyazawa ..... G09G 3/3233 345/76
2007/0063959 A1* 3/2007 Iwabuchi ..... G09G 3/2074 345/100
2007/0203590 A1* 8/2007 Matsumoto ..... G05B 19/0426 700/84
2008/0170029 A1* 7/2008 Kim ..... G09G 3/3266 345/100
2008/0246698 A1* 10/2008 Eom ..... G09G 3/3266 345/76
2009/0033642 A1* 2/2009 Chiang ..... G11C 19/28 345/204
2009/0128541 A1* 5/2009 Tsai ..... G09G 3/3677 345/213
2010/0076612 A1* 3/2010 Robertson ..... H02M 5/4505 700/286
2010/0194735 A1* 8/2010 Ohtsubo ..... G09G 3/3666 345/211
2010/0194793 A1* 8/2010 Uehara ..... G09G 3/20 345/691
2010/0283776 A1* 11/2010 Park ..... G09G 3/3233 345/211
2010/0303195 A1* 12/2010 Wang ..... G09G 3/3674 377/64
2011/0096027 A1* 4/2011 Jeon ..... G06F 3/0412 345/175
2011/0157152 A1* 6/2011 Byun ..... G09G 3/3233 345/214
2011/0221731 A1* 9/2011 Tae ..... G02F 1/136213 345/211
2012/0206434 A1* 8/2012 Tsai ..... G09G 3/3677 345/212
2013/0113775 A1* 5/2013 Seo ..... G09G 3/3208 345/211
2013/0169609 A1* 7/2013 Son ..... G11C 19/28 345/209
2013/0300773 A1* 11/2013 Kim ..... G09G 5/10 345/690
2015/0138180 A1* 5/2015 Park ..... G09G 3/3233 345/212
2015/0212381 A1* 7/2015 Wu ..... G09G 3/3655 349/41

FOREIGN PATENT DOCUMENTS

CN 101051440 A 10/2007
CN 102820007 A 12/2012
KR 20060015812 A 2/2006

* cited by examiner

SCAN DRIVER AND ORGANIC LIGHT EMITTING DISPLAY DEVICE USING THE SAME

This application claims the benefit of Korean Patent Application No. 10-2014-0083311, filed on Jul. 3, 2014, which is incorporated herein by reference for all purposes as if fully set forth herein.

BACKGROUND

Field of the Invention

This document relates to an organic light emitting display device, and more particularly, to an organic light emitting display device having a scan driver.

Discussion of the Related Art

With the development of information technology, the market for display devices (i.e., media connecting users and information) is growing. In line with this trend, the use of display devices, such as organic light emitting displays (OLEDs), liquid crystal displays (LCDs), flat panel displays (FPDs), etc, is increasing.

An organic light emitting display device, out of the aforementioned display devices, includes a display panel including a plurality of subpixels and a drive part that drives the display panel. The drive part includes a gate driver for supplying a scan signal (or gate signal) to the display panel and a data driver for supplying a data signal to the display panel.

When a scan signal, data signal, etc are supplied to subpixels arranged in a matrix form, an organic light emitting display device is able to display an image by allowing selected subpixels to emit light.

Organic light emitting display devices have high contrast ratios and good color reproduction, but require compensation circuits for compensating for non-uniformities in the characteristics of thin film transistors, etc. The compensation circuits may be broadly classified into internal compensation circuits and external compensation circuits depending on the compensation method. The internal compensation circuits are created within a subpixel, and the external compensation circuits are created outside a subpixel.

However, internal compensation in organic light emitting display devices may face unexpected problems, so display panels or drive circuits need to be designed considering these problems.

SUMMARY

Accordingly, the present invention is directed to a scan driver and an organic light emitting display device using the same that substantially obviate one or more of the problems due to limitations and disadvantages of the related art.

An object of the present invention to provide a scan driver and an organic light emitting display device having improved performance.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an organic light emitting display device comprises a display panel; a data driver that supplies a data signal to the display panel; and a scan driver that supplies a scan signal to the display panel, the scan driver comprising a shift register and an inverter that inverts a scan signal output through the output terminal of the shift register and outputs the inverted scan signal, wherein the shift register and the inverter are connected to separate voltage lines through which a gate-low voltage is delivered.

In another aspect, the present invention provides a scan driver comprising: a shift register; and an inverter that inverts a scan signal output through the output terminal of the shift register and outputs the inverted scan signal, wherein the shift register and the inverter are connected to separate voltage lines through which a gate-low voltage is delivered.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are include to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Reference will now be made in detail to embodiments of the invention, examples of which are illustrated in the accompanying drawings.

Hereinafter, a specific exemplary embodiment of the present invention will be described in detail with reference to the attached drawings.

Figure 1:
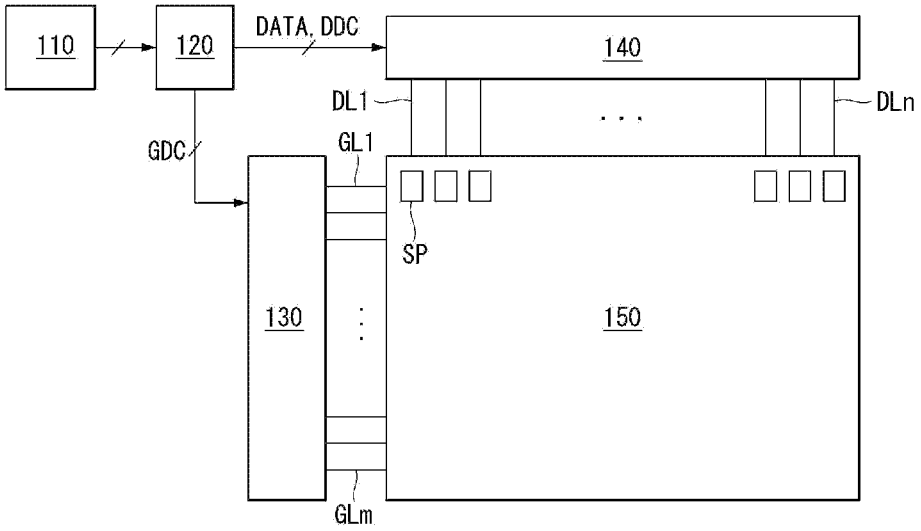
FIG. 1 is a block diagram schematically showing an organic light emitting display device.
Figure 2:
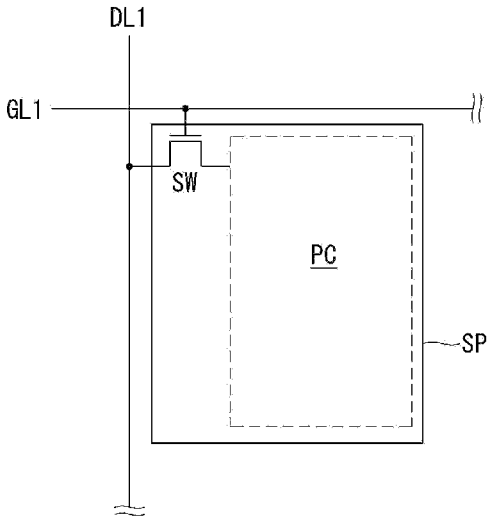
FIG. 2 is a configuration view of a subpixel of FIG. 1.
Figure 3:
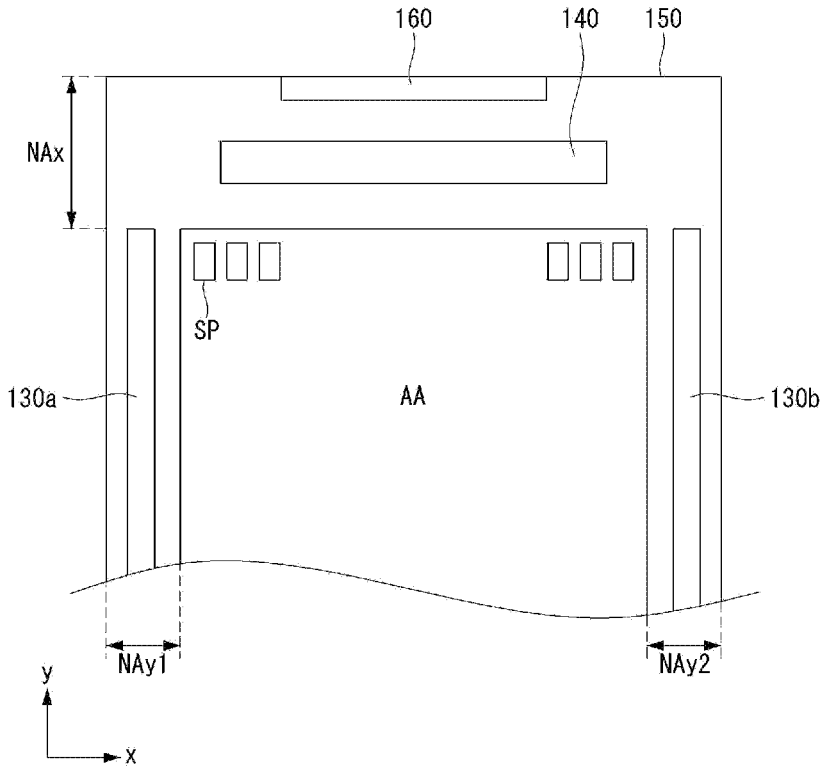
FIG. 3 is a view schematically showing a plane of a display panel of FIG. 1.

FIG. 1 is a block diagram schematically showing an organic light emitting display device, FIG. 2 is a configuration view of a subpixel of FIG. 1, and FIG. 3 is a view schematically showing a plane of a display panel of FIG. 1.

As shown in FIG. 1, the organic light emitting display device comprises an image processor 110, a timing controller 120, a scan driver 130, a data driver 140, and a display panel 150.

The image processor 110 processes a data signal into an image, and outputs it together with a vertical synchronization signal, horizontal synchronization signal, data enable signal, clock signal, etc. The image processor 110 supplies the vertical synchronization signal, horizontal synchronization signal, data enable signal, clock signal, etc to the timing controller 120.

The timing controller 120 receives a data signal, etc from the image processor 110, and outputs a gate timing control signal GDC for controlling the operation timing of the scan driver 130 and a data timing control signal DDC for controlling the operation timing of the data driver 140. The timing controller 120 supplies the data signal DATA, together with the data timing control signal DDC, to the data driver 140.

The scan driver 130 outputs a scan signal while shifting the level of a gate voltage, in response to the gate timing control signal GDC supplied from the timing controller 120. The scan driver 130 comprises a level shifter and a shift register. The scan driver 130 supplies a scan signal to the subpixels SP included in the display panel 150 through scan lines GL1 to GLm. The scan driver 130 is formed on the display panel 150 in the form of a Gate-In-panel. The portion formed in the scan driver 130 using the Gate-In-Panel technology is a shift register.

The data driver 140 samples and latches a data signal DATA in response to the data timing control signal DDC supplied from the timing controller 120, and converts an analog signal into a digital signal and outputs it in response to a gamma reference voltage. The data driver 140 supplies the data signal DATA to the subpixels SP included in the display panel 150 through data lines DL1 to DLn. The data driver 140 is formed in the form of an integrated circuit (IC).

The display panel 150 displays an image in response to a scan signal supplied from the scan driver 130 and a data signal DATA supplied form the data driver 140. The display panel 150 may be a top-emission type, bottom-emission type, or dual-emission type. The display panel 150 comprises subpixels SP that self-emit light to display an image.

As shown in FIG. 2, one subpixel comprises a switching transistor SW connected to (or formed at the intersection of a scan line GL1 and a data line DL1) and pixel circuits PC that operate in response to a data signal DATA supplied through the switching transistor SW. The pixel circuits PC comprises circuits such as a driving transistor, a storage transistor, and an organic light emitting diode, and compensation circuits for compensating these circuits. A description of the compensation circuits will be given later.

As shown in FIG. 3, an active area AA, a scan driver 130*a* and 130*b*, a data driver 140, and signal pads 160 are formed on the display panel 150. The image processor 110 and timing controller 120 explained with reference to FIG. 1 are not shown as they are formed on an external substrate.

An active area AA comprises subpixels SP. A bezel area corresponding to non-active areas NAx, NAy1, and NAy2 are defined outside the active area AA. The first and second non-active areas NAx and Nay1 are defined as a side bezel area, and the third non-active area NAx is defined as a lower bezel area in the present invention (which may be defined as an upper bezel area depending on which direction it is viewed from).

The scan driver 130*a* and 130*b* is formed in the side bezel area of the display panel 150 or on an external substrate. If the scan driver 130*a* and 130*b* is formed in the form of a Gate-In-Panel, it is formed in the first and second non-active areas NAy1 and NAy2 corresponding to the left and right sides of the active area AA, as shown in the drawing. In this case, the scan driver 130*a* and 130*b* may be formed in both or either one of the first and second non-active areas NAy1 and NAy2, depending on the resolution or size of the display panel 150.

Signal pads 160 are formed on the outermost region of the display panel 150. The signal pads 160 consist of a plurality of pads, which may be formed on an outermost portion of the third non-active area NAx or on an outermost portion of the first and second non-active areas NAy1 and NAy2, depending on the resolution or size of the display panel 150.

Typically, the timing controller 120, a power supply part, etc. are mounted in the form of an integrated circuit on an external substrate (e.g., printed circuit board). Accordingly, the signal pads 160 are portions connecting to the external substrate where the timing controller 120, etc. are formed, and serve to deliver and supply various signals or electric power output from the external substrate to the display panel 150.

The data driver 140 may be formed in the third non-active area NAx situated between the signal pads 160 formed on the display panel 150 and the active area AA. In this case, the data driver 140 is configured as an integrated circuit and mounted on bump pads formed on the display panel 150. However, if the display panel 150 has a high resolution or a large size, the data driver 140 is not formed in the third non-active area NAx, but instead mounted on the external substrate.

Meanwhile, the aforementioned organic light emitting display devices have high contrast ratios and good color reproduction, but require compensation circuits for compensating for non-uniformities in the characteristics of thin film transistors, etc. The compensation circuits may be broadly classified into internal compensation circuits and external compensation circuits depending on the compensation method. The internal compensation circuits are created within a subpixel, and the external compensation circuits are created outside a subpixel.

However, internal compensation in organic light emitting display devices may face unexpected problems, so display panels or drive circuits need to be designed considering these problems.

Hereinafter, an exemplary embodiment for improving the reliability and display quality of an organic light emitting display device comprising internal compensation circuits will be described with reference to a test example.

Test Example

Figure 4:
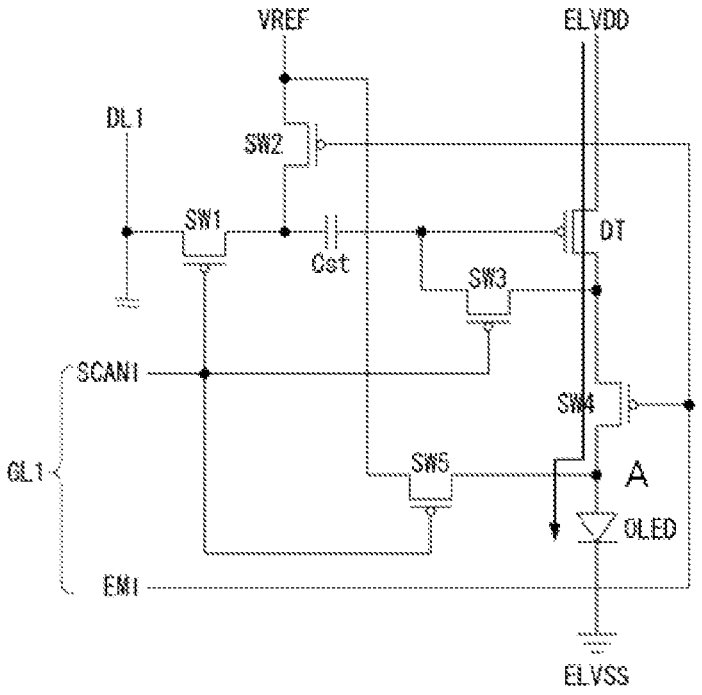
FIG. 4 is a view illustrating the circuit configuration of a subpixel comprising internal compensation circuits.
Figure 5:
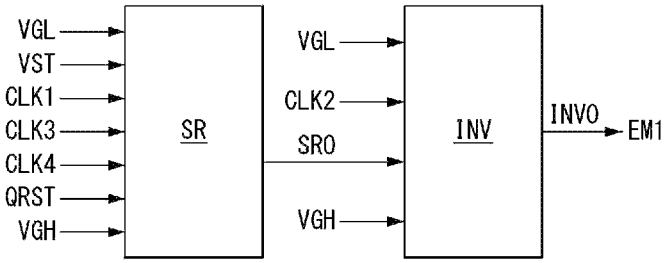
FIG. 5 is a block diagram partially showing a scan driver according to a test example.
Figure 6:
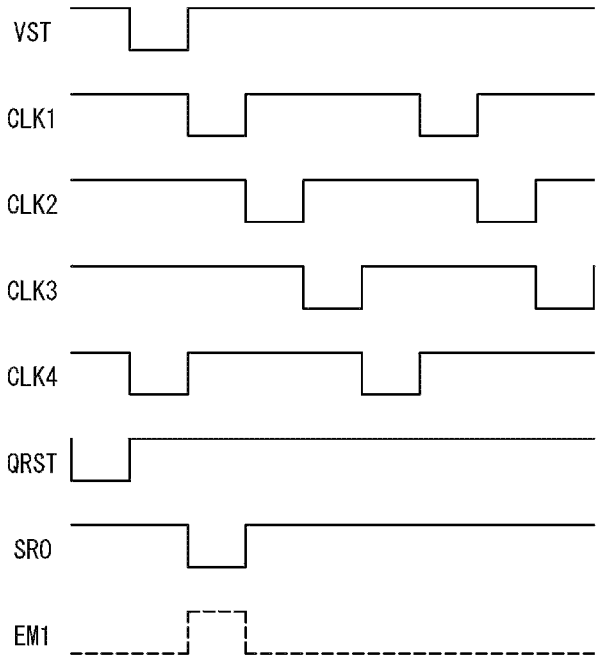
FIG. 6 is a diagram illustrating the input/output waveforms of the scan driver of FIG. 5.
Figure 7:
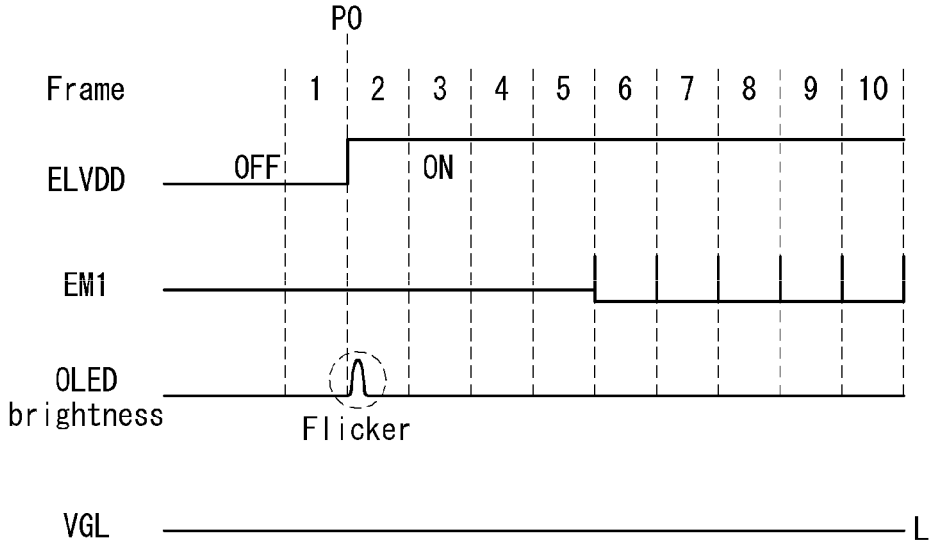
FIG. 7 is a diagram illustrating the waveforms of a power-on sequence for explaining a problem with the test example.
Figure 8:
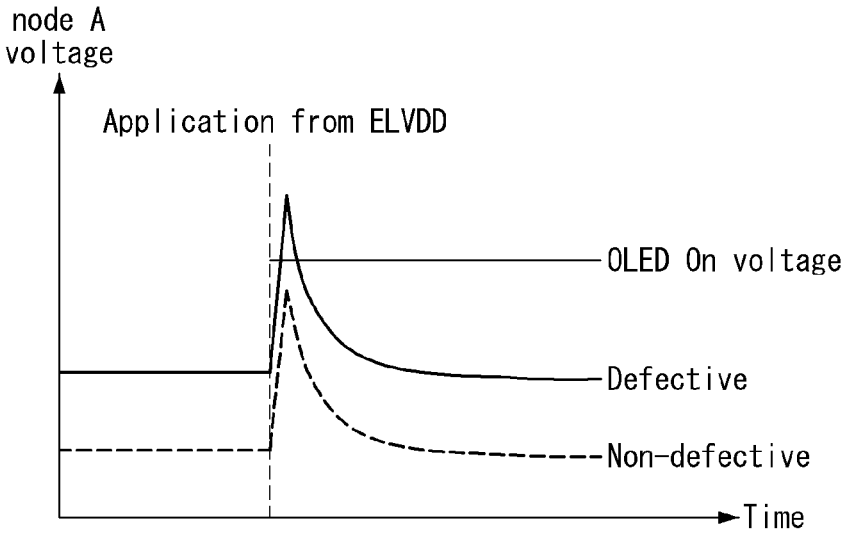
FIG. 8 is a waveform diagram for explaining the principle of how flicker occurs in more details.

FIG. 4 is a view illustrating the circuit configuration of a subpixel comprising internal compensation circuits, FIG. 5 is a block diagram partially showing a scan driver according to a test example, FIG. 6 is a diagram illustrating the input/output waveforms of the scan driver of FIG. 5, FIG. 7 is a diagram illustrating the waveforms of a power-on sequence for explaining a problem with the test example, and FIG. 8 is a waveform diagram for explaining the principle of how flicker occurs in more details.

As shown in FIG. 4, a subpixel according to the test example comprises a first switching transistor SW1, a driving transistor DT, a storage capacitor Cst, and an organic light emitting diode OLED which are basic circuits. The subpixel according to the test example further comprises second to fifth switching transistors SW2 to SW5 which are internal compensation circuits.

The configurations, connection relations, and functions of the second to fifth switching transistors SW2 to SW5 which are internal compensation circuits will be briefly described below.

The second switching transistor SW2 serves to supply a reference voltage to a node connected to the first switching transistor SW1 and the storage capacitor Cst. The third switching transistor SW3 serves to form the driving transistor DT by diode connection to help sense the threshold voltage of the driving transistor DT. The fourth switching transistor SW4 serves to control the light emission of the organic light emitting diode OLED. The fifth switching transistor SW5 serves to supply an initialization voltage to a node A of the anode of the organic light emitting diode OLED.

As shown in FIG. 5, the scan driver according to the test example comprises a shift register SR and an inverter INV. The scan driver of FIG. 5 serves to output a control signal for controlling the gate electrodes of the second and fourth switching transistors SW2 and SW4.

The shift register SR operates based on a signal or voltage supplied through a gate-low voltage line VGL, start signal line VST, first, third, and fourth clock signal lines CLK1, CLK3, and CLK4, reset signal line QRST, and gate-high voltage line VGH.

The shift register SR outputs a signal of logic high or logic low through its output terminal SRO based on a signal or voltage supplied through a gate-low voltage line VGL, start signal line VST, first, third, and fourth clock signal lines CLK1, CLK3, and CLK4, reset signal line QRST, and gate-high voltage line VGH.

The inverter INV operates based on a signal or voltage supplied through the gate-low voltage line VGL, the shift register's output terminal SRO, the second clock signal line CLK2, and the gate-high voltage line VGH.

The inverter INV outputs a signal of logic high or logic low through its output terminal INVO based on a signal or voltage supplied through the gate-low voltage line VGL, the shift register's output terminal SRO, the second clock signal line CLK2, and the gate-high voltage line VGH.

As shown in FIG. 6, when a logic high signal is output from the output terminal SRO of the shift register, the scan driver according to the test example inverts the logic high signal into a logic low signal and outputs the logic low signal. On the contrary, when a logic low signal is output from the output terminal SRO of the shift register, the inverter INV of the scan driver according to the test example inverts the logic low signal into a logic high signal and outputs the logic high signal. As can be seen from the waveforms of FIG. 6, the scan driver according to the test example maintains the logic low signal for a long period of time after outputting the logic high signal.

As shown in FIGS. 4 to 6, the output terminal INVO of the inverter is connected to a control signal line EM1 of the subpixel. The second and fourth switching transistors SW2 and SW4, which are internal compensation circuits of the subpixel, are turned on or off, in response to a control signal output through the output terminal INVO of the inverter.

The fourth switching transistor SW4 controls light emission only when a logic high signal is output from the output terminal INVO of the inverter of the scan driver according to the test example, thereby causing the subpixel to emit light. The subpixel emits light only when a logic high signal is output form the output terminal INVO of the inverter of the scan driver according to the test example as shown in FIG. 6.

By the way, an organic light emitting display device may be embodied in a smartphone, cellular phone, etc. Smartphones and cellular phones are configured to be switched off if there is no input from the user for a certain period of time. To unlock the phone, the user has to press a button (e.g., power button) for turning on the screen.

In the test example, however, when the screen turn-on button (e.g., power button) was pressed (at time PO), as shown in the power-on sequence of FIG. 7, flicker (that is, an instantaneous leap in brightness) occurred after a high-potential power was applied from a high-potential power line ELVDD. At that point in time, the scan driver according to the test example was outputting a gate-low voltage through the output terminal INVO of the inverter. Then, the scan driver according to the test example outputs a normal control signal after a given period of time since the application of the high-voltage power (after the scan driver returns to normal).

As shown in FIG. 8, if the anode voltage of the organic light emitting diode OLED exceeds the turn-on voltage (OLED On voltage) of the organic light emitting diode since the application of the high-power voltage supplied through the high-potential power line ELVDD, it is considered defective.

In an analysis of the cause of the flicker in the test example, the result showed that this was because the transistors (e.g., SW2 and SW4) corresponding to the compensation circuits ran abnormally due to the residual charge in the subpixel. The residual charge was distributed across different nodes of the subpixel over time. It was revealed that the test example had a problem of current flow into the organic light emitting diode OLED as the transistors corresponding to the compensation circuits were turned on after the application of the high-voltage power. Moreover, the test example showed that the residual charge was accumulated in the compensation circuits, etc as the screen turn-on button was turned on and off repeatedly, and this may cause severe flicker.

Exemplary Embodiment

Figure 9:
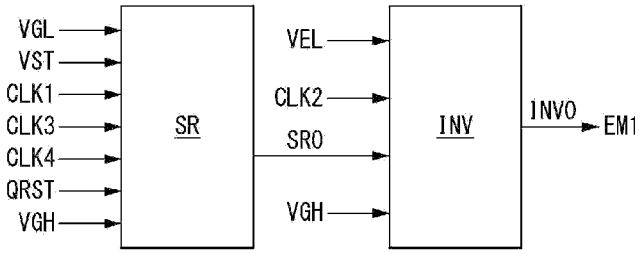
FIG. 9 is a block diagram partially showing a scan driver according to an exemplary embodiment of the present invention.
Figure 10:
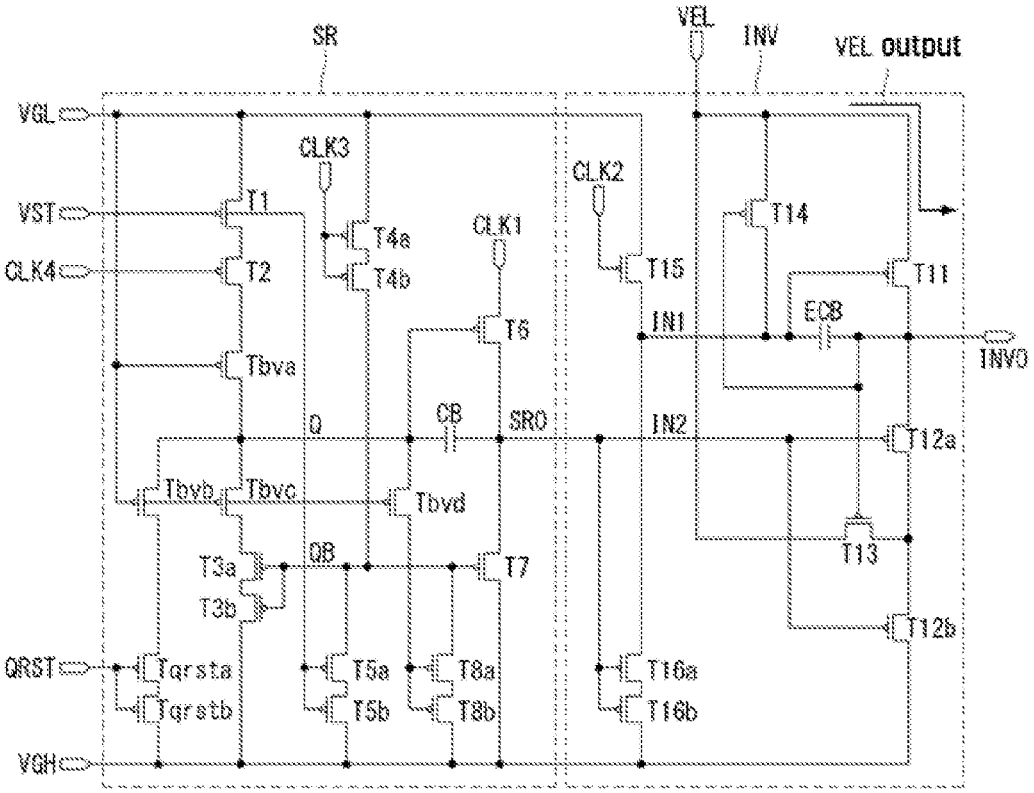
FIG. 10 is a view illustrating the circuit configuration of a shift register and inverter shown in FIG. 9.
Figure 11:
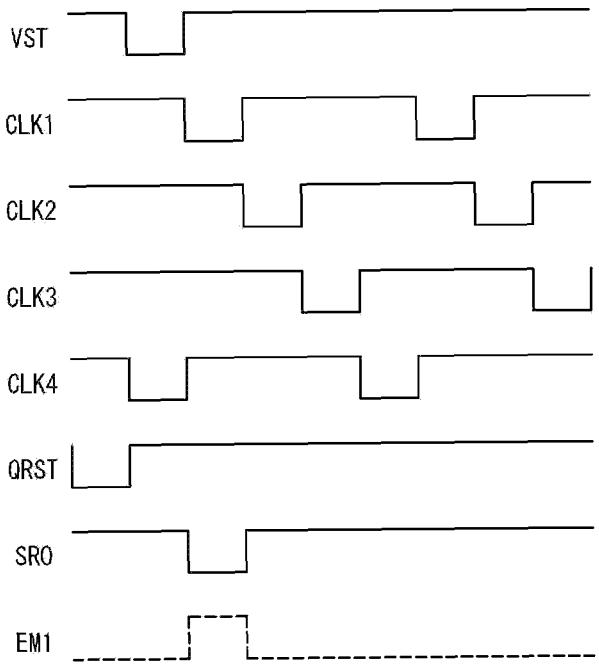
FIG. 11 is a diagram illustrating the input/output waveforms of the scan driver of FIG. 9.
Figure 12:
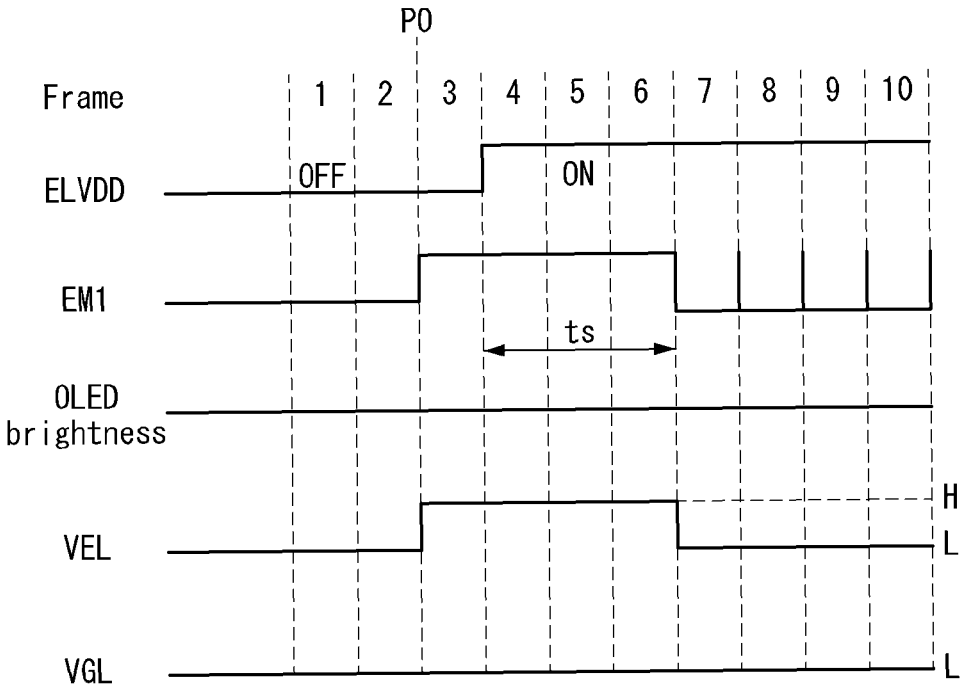
FIG. 12 is a first diagram illustrating the waveforms of a power-on sequence according to the exemplary embodiment.
Figure 13:
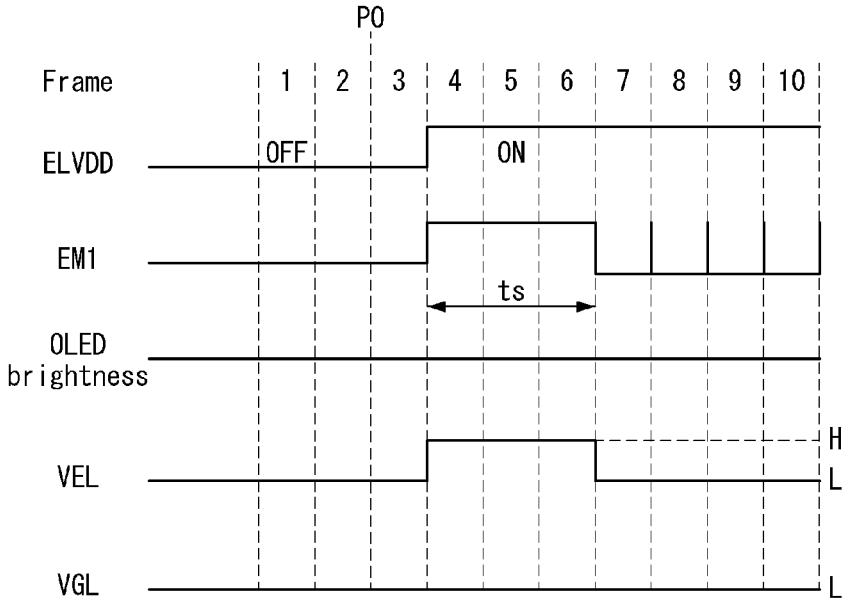
FIG. 13 is a second diagram illustrating the waveforms of a power-on sequence according to the exemplary embodiment.
Figure 14:
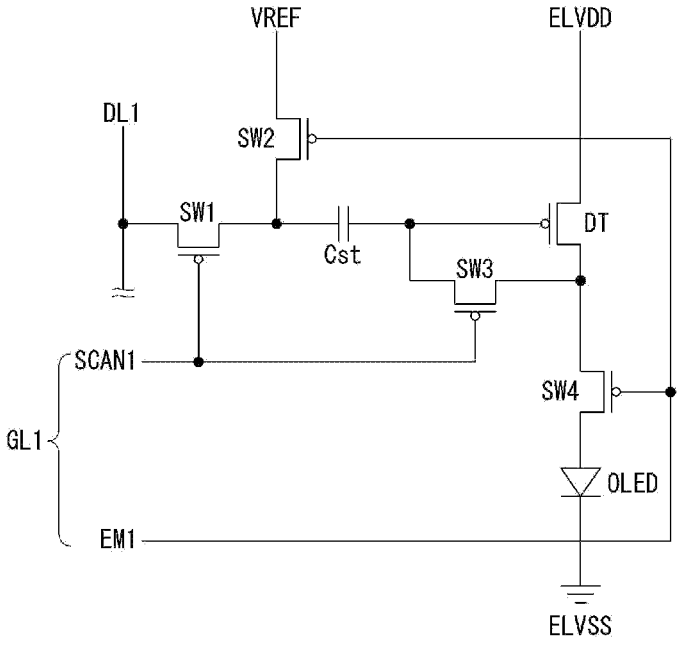
FIG. 14 is a view illustrating a subpixel according to a modification that is applicable to the exemplary embodiment of the present invention.

FIG. 9 is a block diagram partially showing a scan driver according to an exemplary embodiment of the present invention, FIG. 10 is a view illustrating the circuit configuration of a shift register and inverter shown in FIG. 9, FIG. 11 is a diagram illustrating the input/output waveforms of the scan driver of FIG. 9, FIG. 12 is a first diagram illustrating the waveforms of a power-on sequence according to the exemplary embodiment, FIG. 13 is a second diagram illustrating the waveforms of a power-on sequence according to the exemplary embodiment, and FIG. 14 is a view illustrating a subpixel according to a modification that is applicable to the exemplary embodiment of the present invention.

As shown in FIG. 4, a subpixel according to the exemplary embodiment also comprises a first switching transistor SW1, a driving transistor DT, a storage capacitor Cst, and an organic light emitting diode OLED which are basic circuits. The subpixel according to the exemplary embodiment also further comprises second to fifth switching transistors SW2 to SW5 which are internal compensation circuits.

The first switching transistor SW1, driving transistor DT, storage capacitor Cst, and organic light emitting diode OLED which are basic circuits will be described below.

The first switching transistor SW1 comprises a gate electrode connected to a first scan line SCAN1, a first electrode connected to a first data line DL1, and a second electrode connected to one end of the storage capacitor Cst. The first switching transistor SW1 serves to deliver a data signal to the storage capacitor Cst in response to a first scan signal.

One end of the storage capacitor Cst is connected to the second electrode of the first switching transistor SW1, and the other end is connected to the gate electrode of the driving transistor DT. The storage capacitor Cst serves to store a data signal as a data voltage.

The driving transistor DT comprises a gate electrode connected to the other end of the storage capacitor Cst, a first electrode connected to a high-potential power line ELVDD, and a second electrode connected to the first electrode of the fourth switching transistor SW4. The driving transistor DT serves to cause driving current to flow in response to the data voltage stored in the storage capacitor CSt.

The organic light emitting diode OLED comprises an anode connected to a node A and a cathode connected to a low-potential power line ELVSS. The organic light emitting diode OLED serves to emit light in response to a driving current.

The configurations, connection relations, and functions of the second to fifth switching transistors SW2 to SW5 which are internal compensation circuits will be briefly described below.

The second switching transistor SW2 comprises a gate electrode connected to a second scan line EM1, a first electrode connected to a reference voltage line VREF, and a second electrode connected between the first switching transistor SW1 and the storage capacitor Cst. The second transistor SW2 serves to supply a reference voltage to a node connected to the first switching transistor SW1 and the storage capacitor Cst.

The third switching transistor SW3 comprises a gate electrode connected to a first scan line SCAN1, a first electrode connected between the storage capacitor Cst and the gate electrode of the driving transistor DT, and a second electrode connected to the second electrode of the driving transistor DT. The third switching transistor SW3 serves to form the driving transistor DT by diode connection to help sense the threshold voltage of the driving transistor in response to a first scan signal.

The fourth switching transistor SW4 comprises a gate electrode connected to the second scan line EM1, a first electrode connected to the second electrode of the driving transistor DT, and a second electrode connected to the node A of the anode of the organic light emitting diode OLED. The fourth switching transistor SW4 serves to control the light emission of the organic light emitting diode OLED in response to a second scan signal.

The fifth switching transistor SW5 comprises a gate electrode connected to the first scan line SCAN1, a first electrode connected to the reference voltage line VREF, and a second electrode connected to the node A of the anode of the organic light emitting diode OLED. The fifth switching transistor SW5 serves to supply an initialization voltage to the node A of the anode of the organic light emitting diode OLED.

As shown in FIG. 9, the scan driver according to the exemplary embodiment comprises a shift register SR and an inverter INV. The scan driver of FIG. 9 serves to output a second scan signal (hereinafter, referred to as control signal) for controlling the gate electrodes of the second and fourth switching transistors SW2 and SW4. A description of the scan driver that outputs a first scan signal for controlling the gate electrodes of the first, third, and fifth transistors SW1, SW3, and SW5 will be omitted as they are general components.

The shift register SR operates based on a signal or voltage supplied through a gate-low voltage line VGL, start signal line VST, first, third, and fourth clock signal lines CLK1, CLK3, and CLK4, reset signal line QRST, and gate-high voltage line VGH.

The shift register SR outputs a signal of logic high or logic low through its output terminal SRO based on a signal or voltage supplied through a gate-low voltage line VGL, start signal line VST, first, third, and fourth clock signal lines CLK1, CLK3, and CLK4, reset signal line QRST, and gate-high voltage line VGH.

The inverter INV operates based on a signal or voltage supplied through a variable voltage line VEL, the shift register's output terminal SRO, the second clock signal line CLK2, and the gate-high voltage line VGH.

The inverter INV outputs a signal of logic high or logic low through its output terminal INVO based on a signal or voltage supplied through the variable voltage line VEL, the shift register's output terminal SRO, the second clock signal line CLK2, and the gate-high voltage line VGH.

The scan driver according to the exemplary embodiment is different from that according to the test example in that a variable voltage line VEL is connected to the inverter INV. The variable voltage line VEL varies the logical state of a voltage from logic high to logic low or from logic low to logic high, in response to changes in the power-on sequence. Hereinafter, the circuit configuration of the scan driver according to the exemplary embodiment will be embodied, and a description of this will be given.

As shown in FIG. 10, the shift register SR and inverter INV included in the scan driver according to the exemplary embodiment are embodied as transistors and capacitors.

The shift register SR comprises a first circuit portion T1, T2, Tbva, Tbvb, Tbvc, Tbvd, T4*a*, T4*b*, and CB, a second circuit portion Tqrsta, Tqrstb, T3*a*, T3*b*, T5*a*, T5*b*, T8*a*, and T8*b*, and a third circuit portion T6 and T7.

The first circuit portion T1, T2, Tbva, Tbvb, Tbvc, Tbvd, T4*a*, T4*b*, and CB comprises a T1 transistor T1, a T2 transistor T2, a Tbva transistor Tbva, a Tbvb transistor Tbvb, a Tbvc transistor Tbvc, a Tbvd transistor Tbvd, a T4*a* transistor t4*a*, a T4*b* transistor T4*b*, and a first capacitor CB.

The T1 transistor T1 comprises a gate electrode connected to the start signal line VST, a first electrode connected to the gate-low voltage line VGL, and a second electrode connected to the first electrode of the T2 transistor T2. The T1 transistor serves to deliver a gate-low voltage to the first electrode of the T2 transistor T2 in response to a start signal.

The T2 transistor T2 comprises a gate electrode connected to the fourth clock signal line CLK4, a first electrode connected to the second electrode of the T1 transistor T1, and a second electrode connected to the first electrode of the Tbva transistor Tbva. The T2 transistor T2 serves to deliver the gate-low voltage to the first electrode of the Tbva transistor in response to a fourth clock signal.

The Tbva transistor Tbva comprises a gate electrode connected to the gate-low voltage line VGL, a first electrode connected to the second electrode of the T2 transistor T2, and a second electrode connected to a node Q. The Tbva transistor Tbva serves to discharge the node Q in response to the gate-low voltage.

The Tbvb transistor Tbvb comprises a gate electrode connected to the gate-low voltage line VGL, a first electrode connected to the second electrode of the Tqrsta transistor Tqrsta, and a second electrode connected to the node Q. The Tbvb transistor Tbvb serves to charge the node Q with a high-potential-voltage in response to the gate-low voltage.

The Tbvc transistor Tbvc comprises a gate electrode connected to the gate-low voltage line VGL, a first electrode connected to the second electrode of the T3*a* transistor T3*a*, and a second electrode connected to the node Q. The Tbvc transistor Tbvc serves to charge the node Q with the high-potential voltage in response to the gate-low voltage.

The Tbvd transistor Tbvd comprises a gate electrode connected to the gate-low voltage line VGL, a first electrode connected to the second electrode of the T8*a* transistor T8*a*, and a second electrode connected to the node Q. The Tbvd transistor Tbvd serves to control the T8*a* and T8*b* transistors T8*a* and T8*b* in response to the gate-low voltage.

The T4*a* transistor T4*a* comprises a gate electrode connected to the third clock signal line CLK3, a first electrode connected to the gate-low voltage line VGL, and a second electrode connected to the first electrode of the T4*b* transistor T4*b*. The T4*a* transistor T4*a* serves to deliver the gate-low voltage to the T4*b* transistor T4*b* in response to a third clock signal.

The T4*b* transistor T4*b* comprises a gate electrode connected to the third clock signal line CLK3, a first electrode connected to the second electrode of the T4*a* transistor T4*a*, and a second electrode connected to a node QB. The T4*b* transistor T4*b* serves to discharge the node QB with the gate-low voltage in response to the third clock signal.

One end of the first capacitor CB is connected to the node Q, and the other end is connected to the output terminal SRO of the shift register. The first capacitor CB serves to bootstrap an output of the output terminal SRO of the shift register in response to the voltage of the node Q.

The second circuit portion Tqrsta, Tqrstb, T3*a*, T3*b*, T5*a*, T5*b*, T8*a*, and T8*b* comprises a Tqrsta transistor Tqrsta, a Tqrstb transistor Tqustb, a T3*a* transistor T3*a*, a T3*b* transistor T3*b*, a T5*a* transistor T5*a*, a T5*b* transistor T5*b*, a T8*a* transistor T8*a*, and a T8*b* transistor T8*b*.

The Tqrsta transistor Tqrsta comprises a gate electrode connected to the reset signal line QRSTA, a first electrode connected to the second electrode of the Tqrstb transistor, and a second electrode connected to the first electrode of the Tbvb transistor Tbvb. The Tqrsta transistor Tqrsta, together with the Tqrstb transistor Tqrstb, serves to deliver a gate-high voltage to the Tbvb transistor Tbvb in response to a reset signal.

The Tqrstb transistor Tqrstb comprises a gate electrode connected to the reset signal line QRSTA, a first electrode connected to the gate-high voltage line VGH, and a second electrode connected to the first electrode of the Tqrsta transistor Tqrsta. The Tqrstb transistor Tqrstb serves to deliver the gate-high voltage to the Tqrsta transistor Tqrsta in response to the reset signal.

The T3*a* transistor T3*a* comprises a gate electrode connected to the node QB, a first electrode connected to the second electrode of the T3*b* transistor T3*b*, and a second electrode connected to the first electrode of the Tbvc transistor Tbvc. The T3*a* transistor T3*a*, together with the T3*b* transistor T3*b*, serves to deliver the gate-high voltage to the Tbvc transistor Tbvc in response to the potential of the node QB.

The T3*b* transistor T3*b* comprises a gate electrode connected to the node QB, a first electrode connected to the gate-high voltage line VGH, and a second electrode connected to the first electrode of the T3*a* transistor T3*a*. The T3*b* transistor T3*b* serves to deliver the gate-high voltage to the T3*a* transistor T3*a* in response to the potential of the node QB.

The T5*a* transistor T5*a* comprises a gate electrode connected to the start signal line VST, a first electrode connected to the second electrode of the T5*b* transistor T5*b*, and a second electrode connected to the node QB. The T5*a* transistor T5*a*, together with the T5*b* transistor T5*b*, serves to charge the node QB with the gate-high voltage in response to the start signal.

The T5*b* transistor T5*b* comprises a gate electrode connected to the start signal line VST, a first electrode connected to the gate-high voltage line VGH, and a second electrode connected to the first electrode of the T5*a* transistor T5*a*. The T5*b* transistor T5*b* serves to deliver the gate-high voltage to the T5*a* transistor T5*a* in response to the start signal.

The T8*a* transistor T8*a* comprises a gate electrode connected to the first electrode of the Tbvd transistor Tbvd, a first electrode connected to the second electrode of the T8*b* transistor T8*b*, and a second electrode connected to the node QB. The T8*a* transistor T8*a*, together with the T8*b* transistor T8*b*, serves to charge the node QB with the gate-high voltage in response to the potential of the Tbvd transistor Tbvd.

The T8*b* transistor T8*b* comprises a gate electrode connected to the first electrode of the Tbvd transistor Tbvd, a first electrode connected to the gate-high voltage line VGH, and a second electrode connected to the first electrode of the T8*a* transistor T8*a*. The T8*b* transistor T8*b* serves to deliver the gate-high voltage to the T8*a* transistor T8*a* in response to the potential of the Tbvd transistor Tbvd.

The third circuit portion T6 and T7 comprises a T6 transistor T6 and a T7 transistor T7.

The T6 transistor T6 comprises a gate electrode connected to the node Q, a first electrode connected to the first clock signal line CLK1, and a second electrode connected to the output terminal SRO of the shift register. The T6 transistor serves to output the first clock signal to the output terminal SRO of the shift register in response to the potential of the node Q.

The T7 transistor T7 comprises a gate electrode connected to the node QB, a first electrode connected to the gate-high voltage line VGH, and a second electrode connected to the output terminal SRO of the shift register. The T7 transistor T7 serves to output the gate-high voltage to the output terminal SRO of the shift register in response to the potential of the node QB.

The inverter INV comprises a fourth circuit portion T16*a*, T16*b*, T15, T14, T13, T11, T12*a*, and T13*b*.

The fourth circuit portion T16*a*, T16*b*, T15, T14, T13, T11, T12*a*, and T13*b* comprises a T16*a* transistor T16*a*, a T16*b* transistor T16*b*, a T15 transistor T15, a T14 transistor T14, a T13 transistor T13, a T11 transistor T11, a T12*a* transistor T12*a*, and a T13*b* transistor T13*b*.

The T16*a* transistor T16*a* comprises a gate electrode connected to the output terminal SRO of the shift register, a first electrode connected to the second electrode of the T16*b* transistor T16*b*, and a second electrode connected to a first node IN1. The T16*a* transistor T16*a*, together with the T16*b* transistor T16*b*, serves to deliver the gate-high voltage to the first node IN1 in response to the potential of the output terminal SRO of the shift register.

The T16*b* transistor T16*b* comprises a gate electrode connected to the output terminal SRO of the shift register, a first electrode connected to the gate-high voltage line VGH, and a second electrode connected to the first electrode of the T16*a* transistor T16*a*. The T16*b* transistor T16*b* serves to deliver the gate-high voltage to the T16*a* transistor T16*a* in response to the potential of the output terminal SRO of the shift register.

The T15 transistor T15 comprises a gate electrode connected to the second clock signal line CLK2, a first electrode connected to the gate-low voltage line VGL, and a second electrode connected to the first node IN1. The T15 transistor T15 serves to discharge the first node IN1 with the gate-low voltage in response to a second clock signal.

The T14 transistor T14 comprises a gate electrode connected to the output terminal INVO of the inverter, a first electrode connected to the variable voltage line VEL, and a second electrode connected to the first node IN1. The T14 transistor T14 serves to charge or discharge the first node IN1 with a variable voltage in response to the potential of the output terminal INVO of the inverter.

The T13 transistor T13 comprises a gate electrode connected to the output terminal INVO of the inverter, a first electrode connected to the variable voltage line VEL, and a second electrode connected between the first electrode of the T12*a* transistor T12*a* and the second electrode of the T13*b* transistor T13*b*. The T13 transistor T13 serves to deliver the variable voltage between the first electrode of the T12*a* transistor T12*a* and the second electrode of the T13*b* transistor T13*b* in response to the potential of the output terminal INVO of the inverter.

The T11 transistor T11 comprises a gate electrode connected to the first node IN1, a first electrode connected to the variable voltage line VEL, and a second electrode connected to the output terminal INVO of the inverter. The T11 transistor T11 serves to output the variable voltage to the output terminal INVO of the inverter in response to the potential of the first node IN1.

The T12*a* transistor T12*a* comprises a gate electrode connected to a second node IN2, a first electrode connected to the second electrode of the t13*b* transistor T13*b*, and a second electrode connected to the output terminal INVO of the inverter. The T12*a* transistor T12*a* serves to output the variable voltage or the gate-high voltage to the output terminal INVO of the inverter in response to the potential of the second node IN2.

The T13*b* transistor T13*b* comprises a gate electrode connected to the second node IN2, a first electrode connected to the gate-high voltage line VGH, and a second electrode connected to the first electrode of the T12*a* transistor T12*a*. The T13*b* transistor T13*b* serves to deliver the gate-high voltage to the T12*a* transistor T12*a* in response to the second node IN2.

The above description has been given with an example where the transistors constituting the shift register SR and inverter INV of the scan driver are P-type transistors. However, the transistors constituting the shift register SR and the inverter INV may be N-type transistors.

The two electrodes, aside from the gate electrode, of each of the transistors constituting the shift register SR and inverter INV of the scan driver may be source electrodes or drain electrodes depending on the connection direction. Therefore, it should be understood that, in the present invention, two electrodes serving as the source electrode and drain electrode of a transistor are referred to as a first electrode and a second electrode. Accordingly, the first electrode and the second electrode may be a source electrode and a drain electrode, respectively, or vice versa.

As shown in FIG. 11, when a logic high signal is output from the output terminal SRO of the shift register, the scan driver according to the exemplary embodiment inverts the logic high signal into a logic low signal and outputs the logic low signal. On the contrary, when a logic low signal is output from the output terminal SRO of the shift register, the inverter INV of the scan driver according to the exemplary embodiment inverts the logic low signal into a logic high signal and outputs the logic high signal. As can be seen from the waveforms of FIG. 11, the scan driver according to the exemplary embodiment maintains the logic low signal for a long period of time after outputting the logic high signal.

As shown in FIGS. 9 to 11, the output terminal INVO of the inverter is connected to a control signal line EM1 of the subpixel. The second and fourth switching transistors SW2 and SW4, which are internal compensation circuits of the subpixel, are turned on or off, in response to a control signal output through the output terminal INVO of the inverter.

The fourth switching transistor SW4 controls light emission only when a logic high signal is output from the output terminal INVO of the inverter of the scan driver according to the exemplary embodiment, thereby causing the subpixel to emit light. The subpixel emits light only when a logic high signal is output form the output terminal INVO of the inverter of the scan driver according to the test example as shown in FIG. 11.

By the way, an organic light emitting display device may be embodied in a smartphone, cellular phone, etc. Smartphones and cellular phones are configured to be switched off if there is no input from the user for a certain period of time. To unlock the phone, the user has to press a button (e.g., power button) for turning on the screen.

In the exemplary embodiment, when the screen turn-on button (e.g., power button) is pressed (at time PO), as shown in the power-on sequence of FIG. 12, a logic-high signal is output from the output terminal INVO of the inverter of the scan driver for a given period of time ts.

When the exemplary embodiment is compared with the test example, the shift register SR and inverter INV according to the test example share the gate-low voltage line VGL, whereas the shift register SR and inverter INV according to the exemplary embodiment of the present invention do not share the gate-low voltage line VGL, but instead the shift register SR uses the gate-low voltage line VGL and the inverter INV uses the variable voltage line VEL.

Also, the gate-low voltage line VGL connected to the inverter INV of the test example always maintains the gate-low voltage regardless of whether the screen turn-on button is pressed or not. In contrast, the voltage of the variable voltage line VEL connected to the inverter INV according to the exemplary embodiment swings in response to (or in synchronization with) the screen turn-on button.

For instance, as can be seen from the voltage of the gate-low voltage line VGL of FIG. 12, the gate-low voltage line VGL always maintains the gate-low voltage regardless of whether the screen turn-on button is pressed or not. On the contrary, as can be seen from the voltage of the variable voltage line VEL, the variable voltage line VEL maintains the voltage at logic low (L), switches the voltage to logic high (H) in response to a press action on the screen turn-on button, and returns to logic low after a given period of time ts. The logic low (L) level delivered through the variable voltage line VEL corresponds to the gate-low voltage of the gate-low voltage line VGL.

The voltage of the variable voltage line VEL connected to the inverter INV swings between a first voltage and a second voltage. For example, the voltage of the variable voltage line VEL may be set, but not limited to, within the range of −15 V to +15 V. The voltage of the variable voltage line VEL swings such that it is set to a high voltage (+, positive voltage) in an initial power turn-on period and a low voltage (−, negative voltage) in a period when all the circuits of the scan driver run normally.

As can be seen again from the waveforms of FIG. 12, there is a time difference between the time at which a high-potential power is applied from the high-potential power line ELVDD ("OFF" indicates the period during which the high-potential power is not applied, and "ON" indicates the period during which the high-potential power is applied) and the time at which a control signal EM1 output from the scan driver varies from logic low to logic high.

This is because, when the user presses the screen turn-on button, the high-potential voltage from the high-potential power line ELVDD is applied not immediately but after a delay of 1 frame (see the part 3 of Frame). However, it is to be noted that the time at which the high-potential power is applied from the high-potential power line ELVDD is not necessarily limited to FIG. 12.

In another example, referring to FIG. 13, the time at which the high-potential power is applied from the high-potential power line ELVDD and the time at which the control signal EM1 output from the scan driver varies from logic low to logic high may be synchronized by adjusting the voltage swing timing of the variable voltage line VEL.

As stated above, when a high-potential voltage is applied, the scan driver according to the exemplary embodiment outputs a signal for forcedly turning off the transistors corresponding to the compensation circuits for a given period of time ts, and thereafter outputs a normal control signal. That is, the scan driver according to the exemplary embodiment is embodied in such a way that the inverter stably outputs an off voltage when initial running (driving).

As a consequence, when the screen turn-on button is pressed, the transistors corresponding to the compensation circuits are forcedly turned off. Hence, the anode voltage of the organic light emitting diode OLED does not exceed the turn-on voltage of the organic light emitting diode (OLED On voltage) after the application of the high-potential power from the high-potential power line.

In the exemplary embodiment, as the scan driver outputs an off voltage for a given period of time, the transistors (e.g., SW2 and SW4) corresponding to the compensation circuits are kept from running abnormally due to the residual charge. This may suppress flicker (that is, an instantaneous leap in brightness) even when the screen turn-on button is pressed. Moreover, the off voltage of the compensation circuits, etc may be stably maintained even when the screen turn-on button is turned on and off repeatedly, thereby improving or avoiding severe flicker caused by the accumulation of the residual charge.

The test example and the exemplary embodiment have been described with respect to a subpixel comprising such compensation circuits as shown in FIG. 4. However, the configuration of the compensation circuits is not limited to this but may be varied. For example, a modification of the compensation circuits of FIG. 4 will be described below.

As shown in FIG. 14, a subpixel according to the modification also comprises a first switching transistor SW1, a driving transistor DT, a storage capacitor Cst, and an organic light emitting diode OLED which are basic circuits. The subpixel according to the modification also further comprises second to fourth switching transistors SW2 to SW4 which are internal compensation circuits.

The configurations, connection relations, and functions of the second to fourth switching transistors SW2 to SW4 which are internal compensation circuits will be briefly described below.

The second switching transistor SW2 comprises a gate electrode connected to a second scan line EM1, a first electrode connected to a reference voltage line VREF, and a second electrode connected between the first switching transistor SW1 and the storage capacitor Cst. The second transistor SW2 serves to supply a reference voltage to a node connected to the first switching transistor SW1 and the storage capacitor Cst.

The third switching transistor SW3 comprises a gate electrode connected to a first scan line SCAN1, a first electrode connected between the storage capacitor Cst and the gate electrode of the driving transistor DT, and a second electrode connected to the second electrode of the driving transistor DT. The third switching transistor SW3 serves to form the driving transistor DT by diode connection to help sense the threshold voltage of the driving transistor in response to a first scan signal.

The fourth switching transistor SW4 comprises a gate electrode connected to the second scan line EM1, a first electrode connected to the second electrode of the driving transistor DT, and a second electrode connected to the node A of the anode of the organic light emitting diode OLED. The fourth switching transistor SW4 serves to control the light emission of the organic light emitting diode OLED in response to a second scan signal.

In addition to the above-described modification, the present invention may be applicable to other compensation circuit configurations different from the above-described one, in which one of the compensation circuits included in a subpixel of the display panel corresponds to a transistor for controlling the light emission of the organic light emitting diode. The above description has been given with an example where both the basic circuits and compensation circuits of the subpixel are P type. However, the basic circuits and compensation circuits of the subpixel may be designed in N-type and the waveforms of signals applied to these circuits may be changed according to the N-type.

As above, the present invention has the advantage of stably outputting an off voltage to prevent the compensation circuits in the subpixel from running abnormally due to the residual charge when the screen is turned on. Moreover, the present invention has the advantage of suppressing or improving flicker (that is, an instantaneous leap in brightness) when the screen is turned on, by stably outputting an off voltage.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An organic light emitting display device, comprising:

a display panel;

a data driver that supplies a data signal to the display panel; and a scan driver that supplies a scan signal to the display panel, the scan driver comprising a shift register and an inverter that inverts a scan signal output through the output terminal of the shift register and outputs the inverted scan signal, wherein the shift register is connected to a gate-low voltage line, and the inverter is connected to a variable voltage line, wherein the shift register and the inverter do not share the gate-low voltage line;

wherein the gate-low voltage line has a ground voltage potential or a reference voltage potential; and wherein the variable voltage line inverts voltage logical high and low states in response to changes in a power-on sequence.

2. The organic light emitting display device of claim 1, wherein, upon turning on the screen of the display panel, the voltage of the variable voltage line swings between a first voltage and a second voltage that have different levels.

3. The organic light emitting display device of claim 2, wherein, upon turning on the screen of the display panel, the voltage of the variable voltage line is maintained at the second voltage for a given period of time and then maintained at the first voltage after the given period of time.

4. The organic light emitting display device of claim 3, wherein the second voltage of the variable voltage line corresponds to a voltage for turning off a transistor for controlling the light emission of the organic light emitting diode, the transistor corresponding to one of the compensation circuits included in a subpixel of the display panel.

5. The organic light emitting display device of claim 1, wherein, upon turning on the screen of the display panel, the voltage of the variable voltage line swings from a negative voltage to a positive voltage or vice versa.

6. The organic light emitting display device of claim 5, wherein, when a high-potential power is applied to the scan driver, the scan driver outputs a signal for turning off transistors corresponding to the compensation circuits for a given period of time, and thereafter outputs a control signal for normally running the transistors corresponding to the compensation circuits.

7. The organic light emitting display device of claim 1, wherein the voltage of the variable voltage line is varied earlier than or at the same time as the application of the high-potential power.

8. The organic light emitting display device of claim 7, wherein, when a button for turning on the screen of the display panel is pressed, transistors corresponding to the compensation circuits are turned off, and the anode voltage of the organic light emitting diode does not exceed the turn-on voltage of the organic light emitting diode.

9. The organic light emitting display device of claim 1, wherein:

the shift register outputs a signal of logic high or logic low through the output terminal based on a signal supplied through the gate-low voltage line; and the inverter outputs a signal of logic high or logic low as the inverted scan signal based on a signal supplied through the variable voltage line, whereby the shift register and the inverter do not share the gate-low voltage line.

10. A scan driver, comprising:

a shift register; and an inverter that inverts a scan signal output through an output terminal of the shift register and outputs the inverted scan signal, wherein the shift register is connected to a gate-low voltage line, and the inverter is connected to a variable voltage line;

wherein the shift register and the inverter do not share the gate-low voltage line;

wherein the gate-low voltage line has a ground voltage potential or a reference voltage potential; and wherein the variable voltage line inverts voltage logical high and low states in response to changes in a power-on sequence.

11. The scan driver of claim 10, wherein the voltage of the variable voltage line swings between a first voltage and a second voltage that have different levels.

12. The scan driver of claim 11, wherein the voltage of the variable voltage line swings from a negative voltage to a positive voltage or vice versa.

13. The scan driver of claim 11, wherein the second voltage of the variable voltage line corresponds to a voltage for turning off a transistor for controlling the light emission of the organic light emitting diode, the transistor corresponding to one of the compensation circuits included in a subpixel of the display panel.

14. The scan driver of claim 10, wherein, upon turning on a display panel, the display panel including the scan driver, the voltage of the variable voltage line is maintained at the second voltage for a given period of time and then maintained at the first voltage after the given period of time.

15. The scan driver of claim 10, wherein the voltage of the variable voltage line is varied earlier than or at the same time as the application of the high-potential power.

16. The scan driver of claim 10, wherein:

the shift register outputs a signal of logic high or logic low through the output terminal based on a signal supplied through the gate-low voltage line; and the inverter outputs a signal of logic high or logic low as the inverted scan signal based on a signal supplied through the variable voltage line, whereby the shift register and the inverter do not share the gate-low voltage line.

17. A circuit comprising:

a first portion configured to act as a shift register to provide an output signal via an output terminal; and a second portion configured to act as an inverter to invert the output signal at the output terminal of said first portion from a logic high state to a logic low state or vice versa, to turn off one or more transistors in a pixel circuit configured to provide subpixel or pixel-related control in an OLED display, such that an anode voltage of an organic light emitting diode does not exceed a turn-on voltage thereof, wherein said first and second portions, which are operatively connected as part of a scan driver, do not share a gate-low voltage line (VGL) having a ground voltage potential or a reference voltage potential; and wherein said first portion acting as the shift register is connected to the gate-low voltage line (VGL), and said second portion acting as the inverter is connected to a variable voltage line (VEL) which inverts voltage logical high and low states in response to changes in a power-on sequence.

18. The circuit of claim 17, wherein the second portion is connected to the variable voltage line to minimize or prevent flicker effects or other undesirable instantaneous changes in brightness due to residual charges, when compared to a scan driver that lacks said first and second portions.

19. The circuit of claim 18, wherein said power-on sequence is due to activation of a screen turn-on operation or a power turn-on operation.

20. The circuit of claim 19, wherein the first and second portions are configured in a Gate-In-Panel (GIP) implementation, and the pixel circuit has a six-transistor-one-capacitor (6T1C) configuration.

21. The circuit of claim 20, wherein said first and second portions are implemented in a mobile phone or smartphone.

22. The circuit of claim 17, wherein:

the first portion outputs a signal of logic high or logic low through the output terminal based on a signal supplied through the gate-low voltage line; and the second portion outputs a signal of logic high or logic low as an inverted scan signal based on a signal supplied through the variable voltage line, whereby the first portion and the second portion do not share the gate-low voltage line.

* * * * *